US007114583B2

(12) United States Patent
Chrisman

(10) Patent No.: US 7,114,583 B2
(45) Date of Patent: Oct. 3, 2006

(54) TOOL AND METHOD FOR DRILLING, REAMING, AND CUTTING

(76) Inventor: David Scott Chrisman, 2504 Leslie, Pasadena, TX (US) 77502

( * ) Notice: Subject to any disclaimer, the term of this patent is extended or adjusted under 35 U.S.C. 154(b) by 0 days.

(21) Appl. No.: 11/051,110

(22) Filed: Feb. 4, 2005

(65) Prior Publication Data

US 2005/0183891 A1 Aug. 25, 2005

Related U.S. Application Data

(60) Provisional application No. 60/541,800, filed on Feb. 4, 2004.

(51) Int. Cl.
*E21B 7/18* (2006.01)

(52) U.S. Cl. ..... 175/67; 175/424; 175/429; 166/222; 299/17

(58) Field of Classification Search ..... 175/424, 175/429, 67; 166/222, 223; 299/17
See application file for complete search history.

(56) References Cited

U.S. PATENT DOCUMENTS

| | | | | | |
|---|---|---|---|---|---|
| 894,059 | A | * | 7/1908 | Rosborough | 239/240 |
| 3,112,800 | A | | 12/1963 | Bobo | |
| 3,568,783 | A | | 3/1971 | Chenoweth | |
| 3,576,221 | A | | 4/1971 | Hasiba | |
| 3,865,202 | A | | 2/1975 | Takahashi | |
| 4,031,971 | A | * | 6/1977 | Miller | 175/107 |
| 4,042,048 | A | | 8/1977 | Schwabe | |
| 4,175,626 | A | * | 11/1979 | Tummel | 175/424 |
| 4,458,766 | A | * | 7/1984 | Siegel | 175/25 |
| 4,478,368 | A | | 10/1984 | Yie | |
| 4,534,427 | A | | 8/1985 | Wang | |
| 4,555,872 | A | | 12/1985 | Yie | |
| 4,624,327 | A | | 11/1986 | Reichman | |
| 4,689,923 | A | | 9/1987 | Goudeaux | |
| 4,790,394 | A | * | 12/1988 | Dickinson et al. | 175/61 |
| 4,852,668 | A | * | 8/1989 | Dickinson et al. | 175/67 |
| 5,311,955 | A | * | 5/1994 | Ganijew et al. | 175/67 |
| 5,363,927 | A | * | 11/1994 | Frank | 175/67 |
| 5,862,871 | A | | 1/1999 | Curlett | |
| 5,887,667 | A | * | 3/1999 | Van Zante et al. | 175/67 |
| 5,944,123 | A | | 8/1999 | Johnson | |
| 6,263,984 | B1 | * | 7/2001 | Buckman, Sr. | 175/67 |
| 6,386,300 | B1 | | 5/2002 | Curlett | |
| 6,581,700 | B1 | | 6/2003 | Curlett | |
| 6,655,234 | B1 | | 12/2003 | Scott | |
| 6,668,948 | B1 | * | 12/2003 | Buckman et al. | 175/67 |
| 6,679,342 | B1 | | 1/2004 | Portwood | |

OTHER PUBLICATIONS

Knolle, J.J., "Jet Kerfing Parameters for Confined Rock," FlowDril Corp., Kent, WA, pp. 134-144, no date provided.

(Continued)

*Primary Examiner*—David Bagnell
*Assistant Examiner*—Shane Bomar

(57) ABSTRACT

An orbital tool apparatus and method of using the apparatus for boring, drilling, reaming, and cutting having a tool housing, a tool collar located within the housing, the tool housing having the ability to couple to a conduit structure, fluid orbiting jets within the tool collar, and a tool funnel located below the tool collar and within a lower portion of the tool housing. The orbital tool creating a bore in a surface, when fluid flowing into the orbital tool via a conduit is directed out of the orbital tool towards the structure, a portion of the fluid flowing within the orbital tool being diverted through the fluid orbiting jets causing the diverted fluid to impinge against the tool funnel, causing the tool funnel to oscillate creating a sweeping flow towards the surface.

20 Claims, 5 Drawing Sheets

OTHER PUBLICATIONS

Peterson, Carl R. and Hood, Michael, "A New Look at Bit Flushing or the Importance of the Crushed Zone in Rock Drilling and Cutting", no date provided.
Arthur Anderson, Global E&P Trends, Jul. 1999, pp. 3-59.
Killalea, Mike, "High Pressure Drilling System Triple ROPs, Stymies Bit Wear," Drilling, pp. 10-12, no date provided.
Veehuizen, S., Knolle, J.J., Rice, C.C. and O'Hanlos, T.A., "Ultra-High Pressure Jet Assist of Mechanical Drilling", Drilling, Mar./Apr. 1989, pp. 79-90.
Knolle, J.J., (Quest Integrated, Inc.) Otta, R., and Stang, D.L., (FlowDril Corp.), SPE/IADC 22000, pp. 847-856, Mar. 1991.
Summers, D.A., Yao, J., and Wu, W-Z, "A Further Investigation of DIAjet Cutting", Elsevier Science Publishers, Ltd., 1991, Ch. 11, pp. 181-192.
Gas Research Institute, "Deep Drilling Basic Research", vol. 1, pgs. Final Report-Nov. 1998-Aug. 1990.
Journal of Petroleum Technology, "Development of High-Pressure Abrasive-Jet Drilling", May 1981, pp. 1379-1388.
U.S. Department of Commerce, National Technical Information Service, "A Study of the Fragmentation of Rock by Impingement with Water and Solid Impactors", Feb. 1972, No. 131.
Maurer, William C., "Advanced Drilling Techniques", Petroleum Publishing Co., pp. 19-27; vol. 3, pp. 1-68, no date provided.
Singh, Madan, "Rock Breakage by Pellet Impact", IIT Research Institute, Dec. 24, 1969.
Summers, David A., "Waterjetting Technology", no date provided.
Karcher, "Model K 2.40 High Pressure Washer Operator Manual", Aug. 2003.

* cited by examiner

TOOL AND METHOD FOR DRILLING, REAMING, AND CUTTING

CROSS-REFERENCE TO RELATED APPLICATIONS

This application claims priority from U.S. provisional application Ser. No. 60/541,800, filed Feb. 4, 2004.

BACKGROUND OF THE INVENTION

1. Field of the Invention

This invention relates to the field of drilling, reaming, and cutting tools and methods, in particular, to the drilling, reaming, and cutting of subterranean formations.

2. Background Summary

There are massive costs associated with drilling below the earth's surface on land and the sea floor. These costs can broadly be grouped into two categories: capital costs and expenses. Capital costs tend to be one time costs of equipment including, but not limited to, the drilling platform, drilling rig, pump, drill pipe, trucks, tractors, and buildings. Expenses tend to be hourly costs or consumable material including, but not limited to, wages, food and lodging, electricity, water, fuel, equipment rentals, drill bits, drilling mud, geological and geophysical services, cementing services, down-hole tool services, completion and production services, and transportation.

As drilling takes place these costs can be compounded by difficult formations. These difficult formations may include, but are not limited to, hard formations such as granite which wear out drill bits rapidly, sticky formations such as gumbo soil which can adhere to a drill bit and render it ineffective, and combinations of these and other formations. These difficult formations frequently dictate that the driller trips out of the well, corrects the problem by replacing a worn or ineffective bit and then trips back into the well. These round trips in and out of the well are time consuming and costly, often taking many hours, during which time no drilling can occur, while most capital costs and expenses will continue.

In addition to the massive costs of successful drilling operations, there are additional costs associated with problems which may, and often do, arise while drilling. These problems and their associated costs may include, but are not limited to, collapsed wells and broken drill strings resulting in abandonment of the well.

Difficult formations and trips in and out of the well significantly reduce the rate of penetration (ROP) and introduce a dilemma for the driller regarding weight on bit (WOB) caused by the bit contacting the formation. To improve ROP, the driller can increase the WOB to drill hard formations faster, but the drill bit will wear out faster and result in more trips in and out of the well.

None of the current tools and methods described above has provided adequate improvements to the dilemma of WOB, massive costs, and ROP, collectively. The invention described herein significantly improves the collective WOB, cost and ROP deficiencies of the prior art.

BRIEF SUMMARY OF THE INVENTION

The present invention relates to a generally orbital tool having the ability to direct a stream of fluid towards a surface or subterranean formation, causing the formation to fragment creating a bore like structure. In one embodiment of the invention, an orbital tool includes fluid orbiting jets that divert flow with the orbital tool housing towards the side walls of a tool funnel component. In another embodiment, the tool funnel component has the ability to oscillate within the tool housing causing fluid to exit the orbital tool towards a surface or subterranean formation.

In another embodiment of the present invention, an orbital tool is used in connection with a conduit structure, such as a drill string, to allow high pressure fluid mixed with solid particles to flow through the conduit into the orbital tool and impact a surface or subterranean formation.

In another embodiment of the present invention, an orbital tool is made of multiple interchangeable components, which by changing specifications of the orbital tool's component parts, such as diameters, angles, and lengths, or by using multiple fluid orbiting jets, the orbital tool can vary the diameter of a hole or create a non-circular shaped hole such as a line, ellipse, or flat sided bore shape.

In another embodiment of the present invention, an orbital tool is coupled to the traditional drill bit, in order to assist the drill bit in drilling into a surface or a subterranean formation.

BRIEF DESCRIPTION OF THE DRAWINGS

A better understanding of the present invention can be obtained when the following detailed description of an embodiment is considered in conjunction with the following drawing, in which.

DETAILED DESCRIPTION OF EMBODIMENTS OF THE INVENTION

Figure 1:
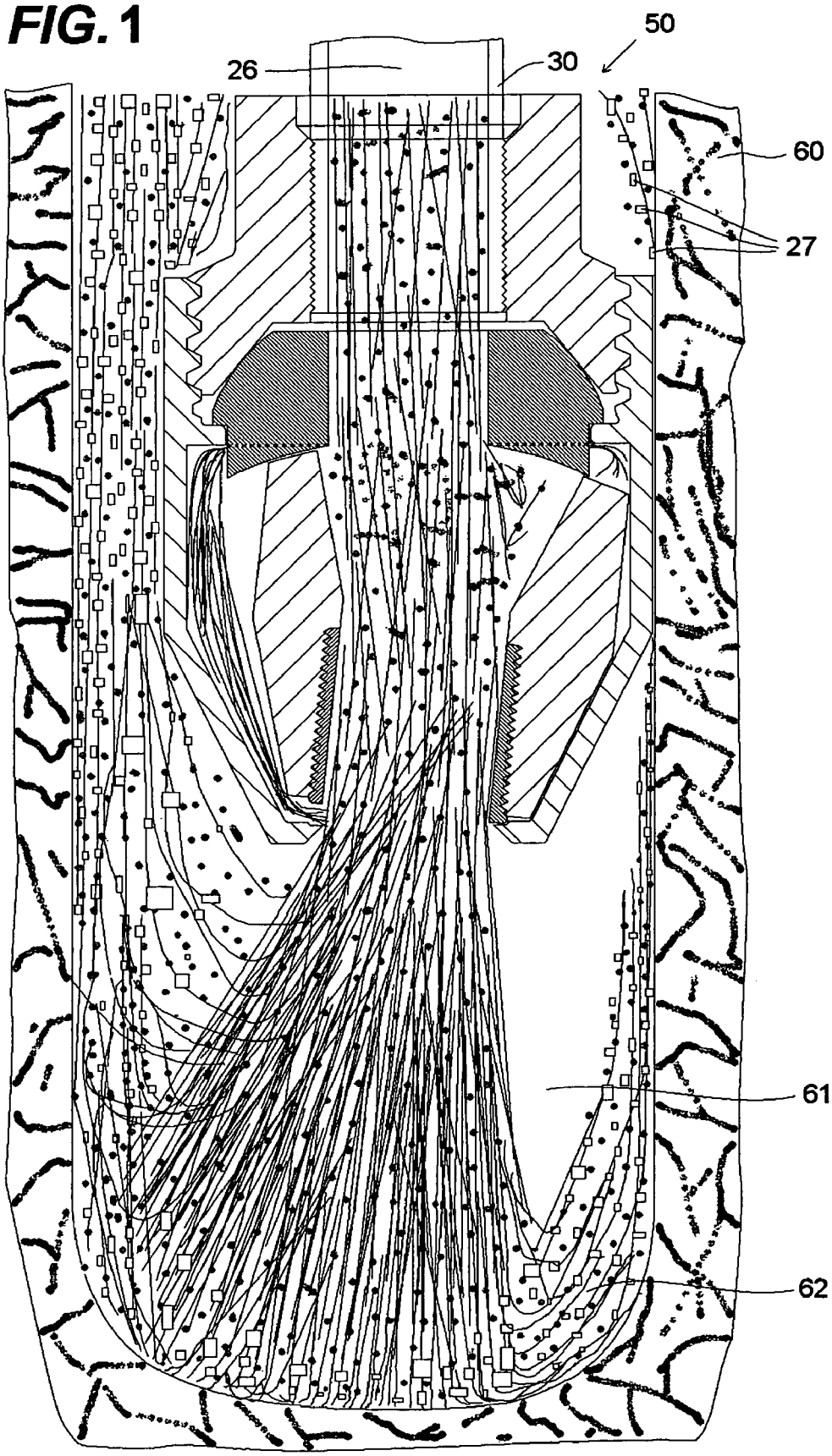
FIG. 1 illustrates an embodiment of the present invention boring a subterranean formation.

FIG. 1 shows one embodiment of an orbital tool 50 of the present invention coupled to a drill sting 30 near the bottom of a well bore 31 within a subterranean formation 60. The drill string 30 having a central passage 26 that allows fluid 25 to flow therein. As shown, the drill string 30 has a female threaded drill collar 3 that facilitates the connection of the orbital tool 50 to the drill string 30. Although FIG. 1 illustrates the orbital tool 50 being coupled to a drill string 30, the orbital tool 50 can be coupled to any type of conduit (e.g. tubing, hose, pipe) that allows fluid 25 to flow therein. Fluid 25, as used herein, refers to fluid in any state—gas, liquid, or solid, singularly or in combination. As will be explained in greater detail below, as the fluid 25 passes through the fluid pipeline 5 and into and out of the orbital tool 50, at least a portion of both the fluid 25 and, where applicable, any solids 24 suspended or mixed within the fluid 25 impinge the subterranean formation causing at least a portion of the subterranean formation to be displaced from the subterranean formation as particles or fragments 27. At least a portion of the particles 27, the fluid 25, and any solids 24 exit the well bore and may pass through a shale-shaker or other separator device.

Figure 2:
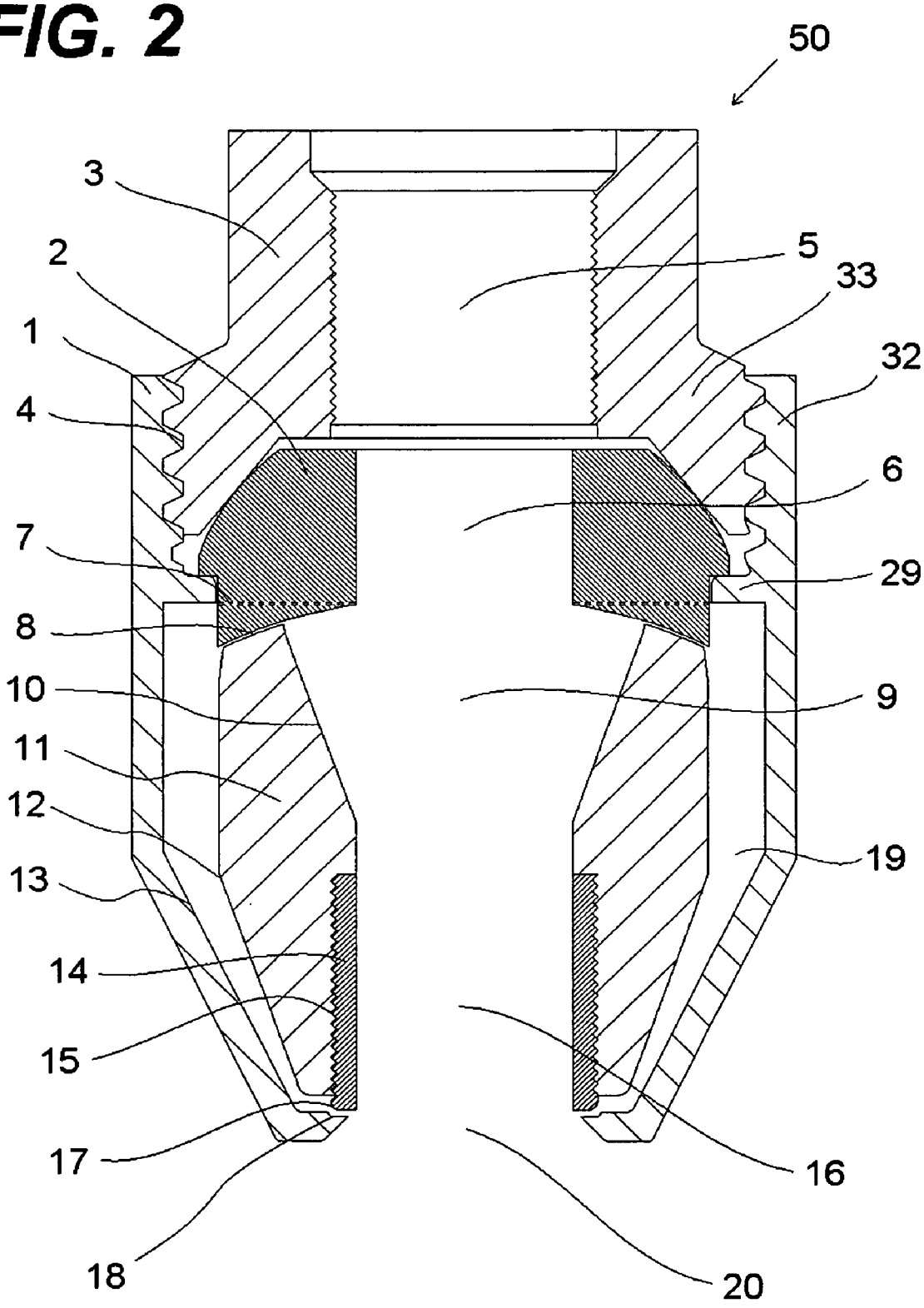
FIG. 2 illustrates a cross sectional view of an embodiment of the present invention.

Referring to FIG. 2, a cross-sectional view of one embodiment of the orbital tool 50 of the present invention is shown. The orbital tool 50 includes a tool housing 1. For illustrative purposes only, the tool housing 1 is shown having female ACME threads 32 that are engaged by the drill collar's 3 male ACME threads 33. Although FIG. 1 illustrates the orbital tool 50 having a threaded connection to the drill collar 3, any suitable connection including but not limited to, a threaded male or female connection (e.g. NPT and ACME threads), a threaded nipple, a flanged connection, a welded connection is considered to be within the scope of an embodiment of the present invention. For example, if the orbital tool 50 is coupled to the end of a hose, the connection can be via a quick connect type fitting, having ball bearings and springs.

As shown in FIG. 2, in one embodiment of the present invention, the tool housing 1 also includes a lip 29 that circumscribes an interior of the housing 1. A tool collar 2, which is a generally cylindrical member, sits atop the lip 29 and when the orbital tool 50 is fully assembled as shown in FIG. 2, the engagement of the tool housings female ACME connection 32 by the drill collar's male ACME connection 33 causes the tool collar 2 to be compressed within the tool housing 1 against lip 29. The use of an ACME connection (32 and 33) is ideal for use in high pressure applications, such as when the orbital tool 50 is used in conjunction with a high discharge pressure pump. As shown in FIG. 2, the top of the tool collar 2 has a downwardly arced shape. However, the tool collar 2 can be of any suitable shape. Because the orbital tool 50 shown in FIG. 2 depicts an ACME conduit connection having a angled surface at its end, the tool collar 2 depicted in FIG. 2 has been constructed to conform to the ACME connection.

Figure 3:
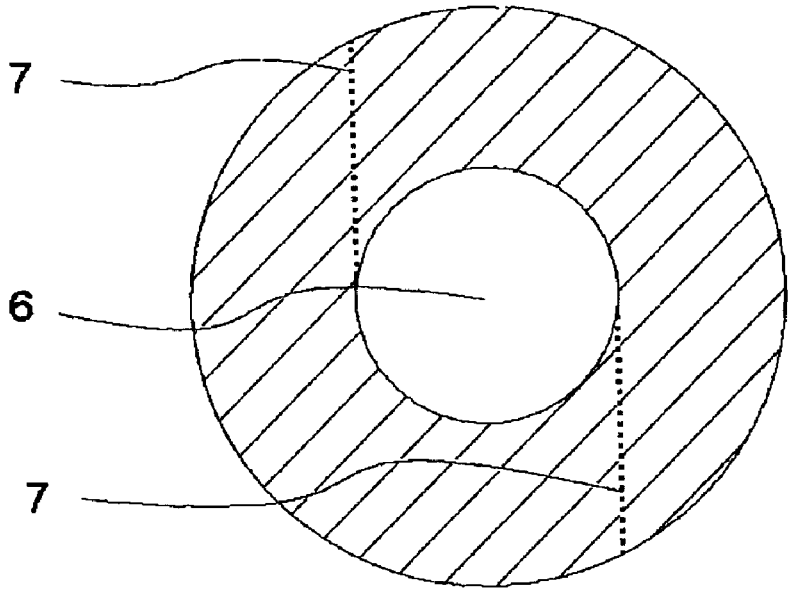
FIG. 3 illustrates a cross sectional view of the tool collar depicted in FIG. 2.

The tool collar 2 also includes fluid orbiting jets 7 (depicted by hidden lines), which are openings that extend in a generally radial direction towards the outer diameter of the tool collar 2. As will be explained in more detail below, the purpose of the tool collar fluid orbiting jets 7 is to provide a path for high pressure fluid 25 flowing in the conduit structure to be diverted along the outer sides of tool funnel 11, creating an orbiting force on the tool funnel 11, and causing the tool funnel 11 to oscillate at a high velocity within the tool housing 1. Although the tool collar 2 of FIG. 2 and the tool collar 2 top sectional view illustrated in FIG. 3 show the tool collar 2 having two fluid orbiting jets 7, the tool collar can have a single or multiple fluid orbiting jets 7. Also, rather than having a single tool collar 2 as shown in FIG. 2, in another embodiment of the invention, a tool collar assembly includes multiple tool collars 2, stacked atop, within, or adjacent one another (e.g. ring shaped devices), wherein at least one of the multiple tool collars has a fluid orbiting jet 7. Similarly, although as shown in FIG. 3, the fluid orbiting jets 7 are shown extending outwardly in a slightly angular direction, the fluid orbiting jets 7 can extend outwardly in any suitable direction, and be located within the tool collar 2 at any suitable location. The angular direction of the fluid orbiting jets 7 can be used to create the direction of orbit of the tool funnel 11.

Additionally, although FIG. 2 illustrates the drill collar 3 and tool collar 2 being made of separate components, it is within the scope of an embodiment of the present invention that the orbital tool 50 components can be integral. For example the drill collar 3 and tool collar 2 can be integral components, such as the orbital tool housing 50 having the drill collar 3 and tool collar 2 are made of a one-piece threaded structure.

In one embodiment of the present invention as shown in FIG. 2, within the tool funnel 11, a firing insert 14 is secured thereto via the tool funnel and firing insert joint 15. The tool funnel 11 and firing insert 14 are enclosed in the tool housing chamber 19 by placing the tool collar 2 into the tool housing 1 and rotating the drill collar 3 in order to engage the tool housing threads 32. As depicted in FIG. 2, the tool funnel 11 has substantial unobstructed movement within the tool housing chamber 19 upon impingement by the fluid 25. Additional features of various embodiments of the invention will be discussed in reference to the operation and use of the orbital tool 50.

For illustrative purposes only, the operation and use of the orbital tool 50 is described in reference to use of the orbital tool 50 in an oil well drilling application. As previously described, the orbital tool 50 may be joined to a standard drill string 30 as shown in FIG. 1 by use of the drill collar 3. The drill string 30 is attached to a drill rig that supplies fluid 25, such as drilling mud mixed with solids 24, to the orbital tool 50 via the drill string 30, and a central bore of the drill fluid pipeline 5. The fluid 25 and solids 24 mixture flow through the orbital tool 50 and the mixture is fired at the subterranean formation causing fragments of the formation to be removed from the formation. The fluid 25 and solids 24 mixture along with the formation fragments are then return circulated to the drilling rig in a stream that surrounds the drill string 30, both of which are typically enclosed in the well bore and or well casing.

Although solids 24 aren't required to be used in conjunction with the orbital tool 50, in some applications solids 24, such as abrasives, steel shots, or grit material are used in drilling, in order to improve drilling, reaming, or cutting. In such applications, where solids 24 are used, the solids 24 are usually added to the fluid 25 under pressure after the fluid 25 has passed through a standard high pressure pump, which is used by the drilling rig to pressurize the fluid 25. Any one of several standard apparatuses such as high pressure injectors, augers or secondary pumps and/or pressurized holding chambers can be used to mix the fluid 25 and solids 24 under pressure after the fluid 25 has been discharged from the rig pump. Typically both the solids 24 and any formation fragments are removed from the fluid 25 after the fluid 25 returns from the well bore. Removal of the solids 24 can be accomplished with any one of several standard apparatus such as augers, filters, screens, baffles, or magnetic collectors in the case of iron, steel or other magnetic solids 24. The fluid 25 and solids 24 can be reused by the drilling system once the fragments of drilled, reamed or cut formation materials are removed from the fluid 25 by standard processes, such as shale shakers or centrifugal separators.

Referring to FIGS. 1–6, the fluid 25 and solids 24 enter a central bore of the drill fluid pipeline 5 and proceed to flow through a tool collar jet 6 of the tool collar 2. The pressure in the drill fluid pipeline 5 forces the fluid 25 out of the tool collar's fluid orbiting jets 7. In applications, in which solids 24 will be used in conjunction with the fluid 25, the fluid orbiting jets 7 are designed to be of a size in comparison to the solids within the fluid 25, that is too small to allow the solids 24 to pass through the tool collar's fluid orbiting jets 7. Hence, the tool collar's fluid orbiting jets 7 tend to act as a filter or screen.

Figure 4:
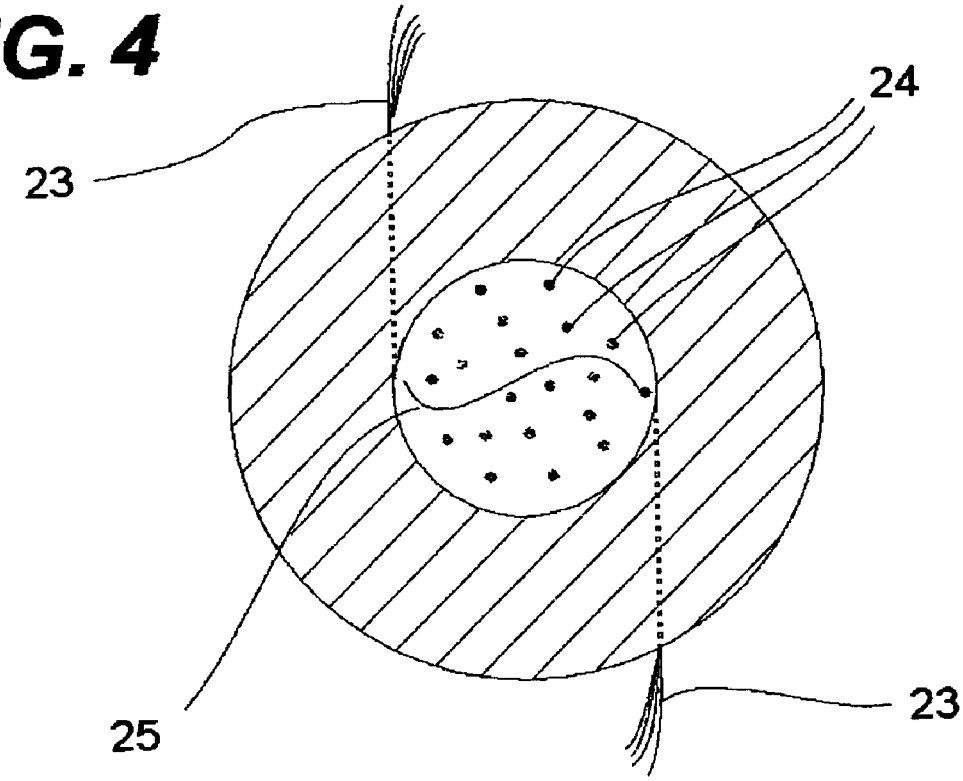
FIG. 4 illustrates a cross sectional view of the tool collar depicted in FIG. 2 illustrating fluid and solid in tool collar jets.
Figure 5:
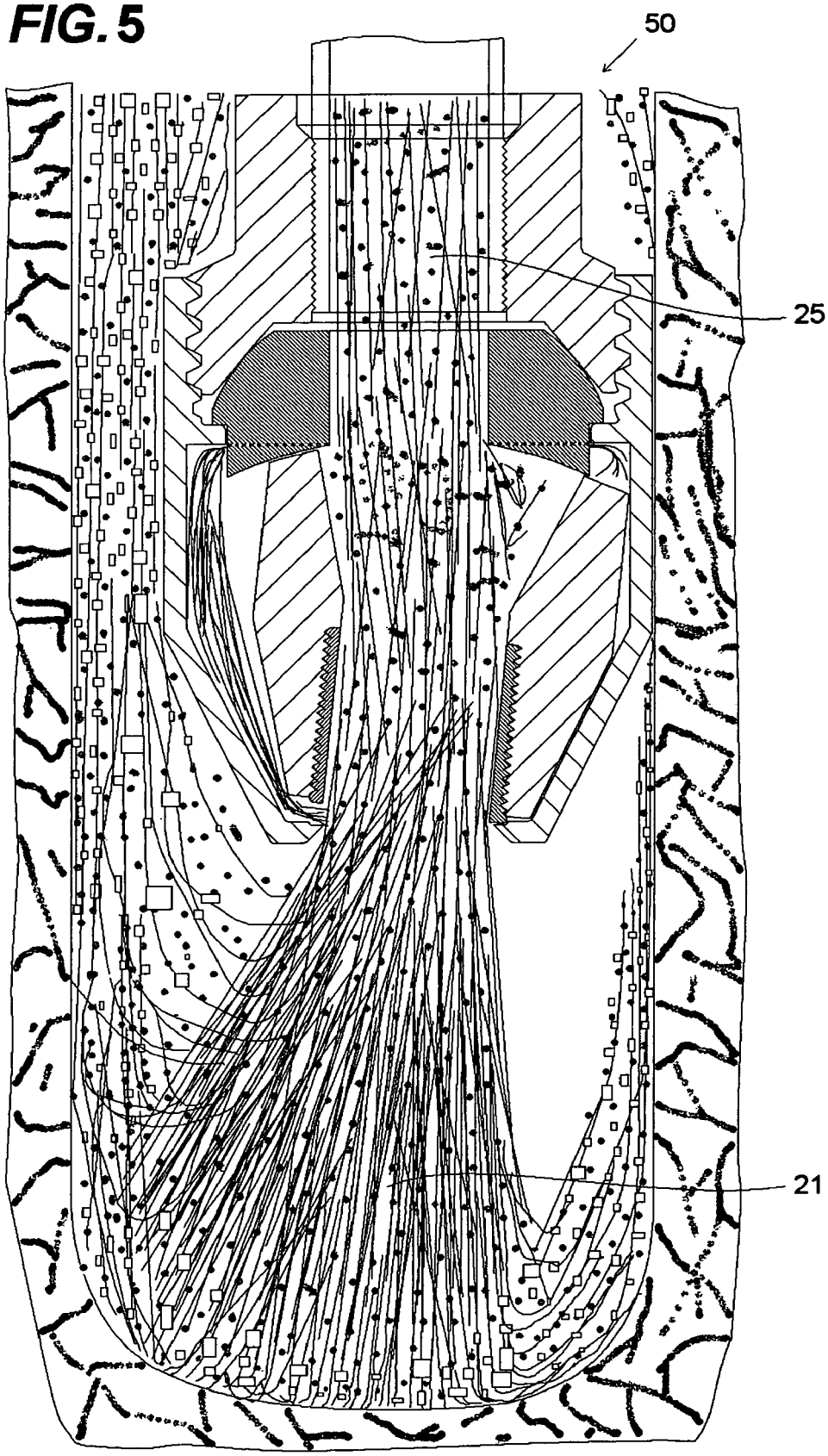
FIG. 5 illustrates a cross sectional view of an embodiment of the present invention having fluid and solids flowing therethrough in a first position.
Figure 6:
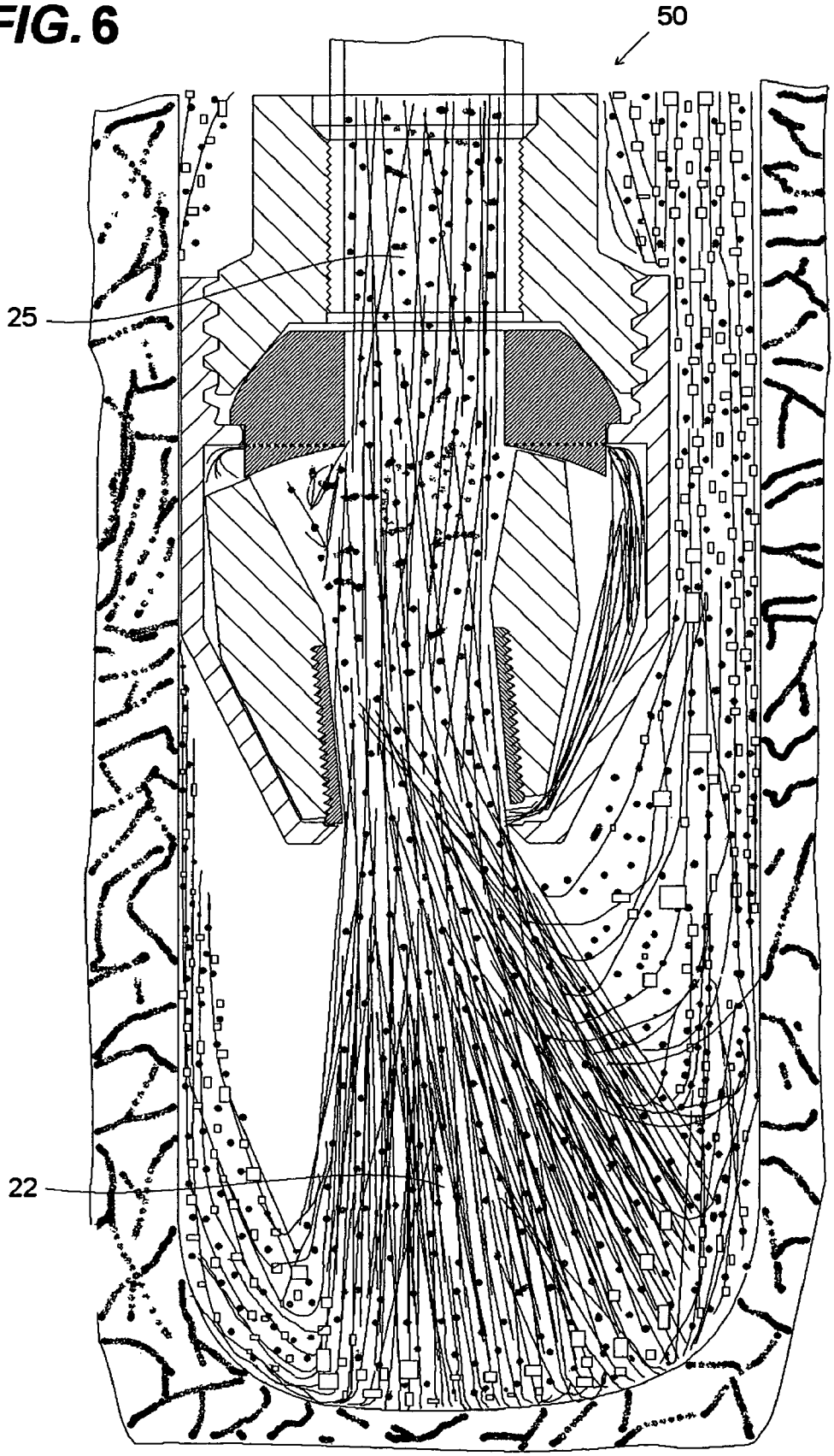
FIG. 6 illustrates a cross sectional view of an embodiment of the present invention having fluid and solids flowing therethrough in a second position

As shown in FIGS. 4–6, the fluid 25 passes through the fluid orbiting jets 7, and enters the tool housing chamber 19 at an angle to create an orbiting force on the tool funnel 11 which orbits at a high velocity inside the tool housing chamber 19. Simultaneously, fluid 25 and solids 24 are forced through the tool collar jet 6 into a funnel chamber 9 impacting a funnel vortex 10 which causes the tool funnel 11 to tilt until the funnel orbital face 12 contacts the tool housing orbital face 13. As the forces of the tool collar jet 6 and the fluid orbiting jets 7 act on the tool funnel 11, the tool funnel 11 orbits within the tool housing 1 at a high velocity in the direction of the orbiting stream 23 using a firing pivot 17 in the tool housing pivot seat 18 as its pivot point. As the tool funnel 11 orbits, fluid 25 and solids 24 are compressed into the funnel vortex 10 and then travel into the firing insert barrel 16 which fires them out of the tool housing vortex 20. The gap size of the funnel tilt buffer 8 acts as a screen or filter to insure no solid 24 will jam, clog, or otherwise stop the tool funnel 11 orbit.

The fluid 25 and solids 24 continue to fire as the tool funnel 11 moves throughout an entire orbit. This creates a generally symmetrical firing pattern commencing with the firing stream, orbit start position 21 and orbiting until it reaches the firing stream, orbit extreme position 22 and then returning to the firing stream orbit start position 21. The result of a full orbit is a generally symmetrical removal of the target material. The velocity of the orbiting stream 23 combined with the volume of fluid 25 and solids 24 repeats this process in high volume and velocity. Although the movement of the orbiting member is described as moving in an orbital pattern, it should be understood that the movement of the orbiting member can include, but is not limited to an oscillating, tilting, rotating, or gyroscopic motion, wherein the movement of the orbital tool 50 in combination with the fluid 25 exiting the tool 50 tends to create a three-dimensional bowl shaped bore in reference to the surface or subterranean formation being impacted by the fluid 25. In another embodiment and interior gear or similar device for synchronizing the orbit of the tool funnel 11, can be installed to reduce wear and improve performance.

Another aspect of an embodiment of the present invention, includes allowing the orbital tool 50 components, such as configuration of tool collar 2, length of firing insert 14, length and diameter of funnel chamber 9, spacing of funnel chamber tilt buffer 8 to be configured based on a given boring application factors and the desired result of a given boring application (e.g. rate of penetration, size of bore created by the orbital tool 50, and the angle of the bore). These factors include but are not limited to, the pressure of the fluid or gas, the hardness of the target formation, the hardness and velocity of the solids, gases, or fluid being fired singularly or in combination, the length of the orbital tool 50 and its associated firing barrel 16 inner diameter, the inner diameter of the conduit central bore, and the angle of the barrel 16. For example, if a larger bore is needed, and assuming the same upstream fluid pressure, such as the pressure from the discharge of a pump, and the same fluid flow, an end user having the orbital tool 50 components could reduce the length of the tool funnel 11 to create the larger bore, for example in a reaming application. Because the firing angle is increased with a reduction in the length of the tool funnel 11, the area bored, drilled, cut, or reamed by the orbital tool 50 is increased. Similarly, if a smaller diameter bore is needed, an increase in the length of the tool funnel 11 will create a smaller angle, thereby creating a smaller diameter bore. All of the foregoing factors and modifications can be enhanced by testing and engineering design to allow the end user to on demand—control the diameter of the bore, control the angle of the bore, and the ROP to address the various target formations encountered in the field.

Another embodiment of the orbital tool 50 of the present invention is the orbital tool's ability to drill a bore hole larger than the diameter of the tool. In this embodiment the bore is created without the need to have the orbital tool 50 come in contact with the formation, thus reducing or eliminating any WOB. Additionally, the flexibility of the orbital tool 50 in increasing the bore size provides the user with the ability to drill through the bore and then ream through devices that may be stuck or abandoned in the bore holes, such as broken drill string, or abandoned drill bits. Additionally, this aspect of an embodiment of the invention allows the user to encase bore holes without the need to telescope the casing. Still other aspect of an embodiment of the invention is its ability to bore through sticky formations, typically the use of roller cone or PDC bits in sticky formations was unproductive, because of the tendency of the formation to adhere to the end of the bit. Thus, because the orbital tool 50 can be operated without the need to contact the formation, the orbital tool 50 is ideal for use in such sticky formations. Moreover, the use of the orbital tool 50 as opposed to a roller cone bit for example is beneficial in formations having intermittent rock formations. Because of the versatility of the orbital tool 50. if a rock formation is encountered the orbital tool simply cuts off the piece of the rock in its path. Still another aspect of an embodiment of the present invention is the eliminating of bore deviation, or "cork screwing" caused by the combination of traditional drill bit contact with the formation, torque on the drill bit and drill string. Although an orbital tool 50 embodying an embodiment of the present invention may rotate, it does not require rotation to perform, and is therefore less susceptible to bore deviation.

Yet another embodiment of the present invention, the orbital tool when drilling a formation creates less fragment or particle debris from the formation, than traditional roller cone or PDC bits. In this embodiment the fluid 25 exiting the tool funnel 11 while fracturing and/or loosening formation particles, also acts as an impactor tending to embed at least a portion of the fragments or particles into the bore sidewalls of the formation. Thus, the amount of debris, particles and fragments removed from the bore during the boring or drilling process is reduced. Not only is the amount of debris reduced, but the embedding of particles into the formation also tends to reduce well collapse, as opposed to the promotion of well collapse caused by traditional drill bits due to their inherent pulling effect on the sidewalls of the formation bore. Moreover, the use of the orbital tool 50 as described herein also decreases wash out of material such as gravel or sand.

In yet another aspect of an embodiment of the present invention, is a method for creating a cavity within a bore for storage, such as the storage of radioactive material housed in bullets. Moreover, because the orbital tool 50 can create bore substantially larger than its out diameter at a length desired by the user, a user could initially drill a bore only large enough to transport a single bullet. Once the user gets to a desired depth for storage of multiple bullets, the user could trip out, change the orbital tool 50 completely, or only a component of the orbital tool, such as inserting a shorter tool funnel 11, that would provide for creating a larger bore. The user could then trip in at the desired storage depth with the modified orbital tool 50 and create a substantially larger opening for storage of multiple bullets that can be stacked, or placed in a circular pattern for example. Moreover, creating cavities such as these can also be used in creating underground heat exchangers, where exchange fluids can be heated by subterranean temperatures.

Yet another embodiment of the present invention is the ability of the orbital tool 50 to alternately fire gas, liquid, and solid singularly or in combination at various temperatures (e.g. a light foam material, a vaporized liquid, or liquefied gas), at the discretion of the operator. For example, the method can allow the tool to cut to a certain depth, firing only fluid 25 at a given pressure, then, upon encountering hard formation, such as granite, begin introducing solids 26 into the fluid at the same or different pressure, to allow cutting/boring of the harder formation; all without tripping in and out to change tools.

Still another embodiment of the present invention is using the orbital tool 50 to create precise openings in well casings. This aspect of an embodiment of the invention is useful when preparing the well for production. Typically, to create openings in the casing, unpredictable blasters or guns are used to penetrate the casing. However, using the orbital tool 50, once a producing reservoir has been located, the user can lower the tool 50 to a precise location and use the tool to bore the casing at exact locations, thereby causing the oil, natural gas or other resource to be accessible.

Yet another embodiment of the present invention is the orbital tool 50 creating a plumb bob effect on the conduit, such as a drill string 30. Because of the plumb bob effect, the orbital tool 50 will drill in a straight direction, as opposed to traditional drill bits, which have a tendency to take the path of least resistance because of their contact with the formation, resulting in bore deviation or "cork screwing."

Another aspect of an embodiment of the present invention is the ability of the ability of the orbital tool 50 to drill or bore in any direction, such as horizontally, vertically downward, or vertically upward, using for example a horizontal drilling device or steerable downhole device for directional drilling in conjunction with the orbital tool 50.

Another embodiment of the present invention is creating a pumping effect with the orbital tool 50, by using a push-pull method while advancing the orbital tool 50 increasing the rate of penetration because the push-pull method, especially when used in hard formations, assists in dislodge particles from the bottom of the well bore due to an alternating pressure-suction effect. The push-pull method includes advancing the orbital tool 50 within the well bore, and retracting the orbital tool 50 over a certain distance.

In still another embodiment of the present invention, the orbital tool 50 is used to mine by pulverizing materials and mixing the pulverized materials into a slurry, which is forced up the well annulus by the orbital tool 50. The mixing of pulverized material into a slurry is described in U.S. Pat. No. 6,824,086, which is incorporated by reference herein.

Many other application and variations of an embodiment of the invention are possible. For example, the orbital tool 50 can be used in manufacturing or construction applications to drill, ream or cut, especially in hard materials or where high rates of penetration are desirable. Additionally, by changing specifications of the component parts of the orbital tool 50 such as diameters, angles, and lengths, or by using multiple jets, the tool 50 can vary the diameter of a hole or create a non-circular shaped hole such as a line, ellipse, or flat sided bore shape. Moreover, the orbital tool 50 can be used in conjunction with standard drilling tools to drill, ream or cut horizontally or on an angle. The orbital tool 50 can drill various hole sizes, ream cavities larger than the bore diameter prior to the area being reamed, cut through well casing for completion and production, create fractures, create in ground heat exchangers for geothermal or other applications, create in ground storage cavities for materials or waste and other useful applications. The orbital tool 50 can be used to destroy lost or unwanted equipment obstructing a well bore, which is a common occurrence in well drilling. The orbital tool 50 can be used to remove scaling, caking or similar fixed debris which blocks passages in drilling applications. The orbital tool 50 can be configured in multiples to increase the diameter of a bore.

In yet another embodiment of the present invention, one or more orbital tools 50 can be used to assist fixed cutter or roller cone bits. Additionally, the orbital tool 50 can be configured with multiple firing jets or varying size jets to fire varying size solids 24 from one fluid 25 with mixed diameter solids 24 in suspense. The orbital tool 50 can remove various target material types and hardnesses by varying the fluid 25 and solid 24 materials, the ratio of fluid 25 to solids 24, and/or the ratio of fluids 25 and solids 24 in combination.

In yet another embodiment of the invention, the orbital tool 50 is a substantially stationary configuration, which produces the same orbital or oscillating firing stream through the use of internal hydraulic forces.

Any suitable material or combination of materials of construction can be used for the orbital tool 50 components, such as hardened steel, carbon fiber, urethane, plastics, brass, or some suitable metal. The suitability of the metal can be based on a myriad of factors, such as the type of drilling fluid 25, the pressures of the drilling system, the solid materials 24, or the type of formation. Additionally, because the orbital tool 50 components are interchangeable, each component of the orbital tool 50 can be made of different materials. For example, the tool collar 2 can be made of stainless steel, while the firing insert 14 could be made of tungsten carbide.

As is evident from the detailed specification herein, an orbital tool 50 embodying an embodiment of the present invention provides significant boring or drilling performance over traditional drill bits in virtually all types of formations, including, hard, sticky, and soft formations, and any combination of formations thereof.

The foregoing disclosure and description of various embodiments of the invention are illustrative and explanatory thereof, and various changes in the details of the illustrated system and method may be made without departing from the scope of the invention.

I claim:

1. An apparatus for drilling, reaming, or cutting, comprising:

a) an orbital housing including a central passageway, said central passageway adapted to receive a multitude of pressurized drilling mixtures of fluid, gas, and solids, at a multitude of pressures and temperatures, from an external supply, said orbital housing central passageway to convey said multitude of pressurized drilling mixtures of fluid, gas, and solids, at said multitude of temperatures, to a generally vertical passageway and to a generally horizontal passageway;

b) a substantially circular orbital member freestanding within said orbital housing, said orbital member including a main bore to receive said multitude of pressurized drilling mixtures of fluid, gas, and solids, at said multitude of pressures and temperatures, from said vertical passageway and convey same out the distal end of said orbital housing, said multitude of pressurized drilling mixtures of fluid, gas, and solids, at said multitude of pressures and temperatures, from said horizontal passageway urging said orbital member to orbit and gyrate, with slight counter-rotation of the substantially circular orbital member in the opposite direction of said orbital member rolling within the substantially circular interior of said orbital housing, thereby minimizing relative movement, friction and wear between the orbital member and orbital housing, said multitude of pressurized drilling mixtures of fluid, gas, and solids, at said multitude of temperatures, from said horizontal passageway urging said orbital housing to orbit and gyrate, whereby drilling, reaming and cutting of target materials, cuttings removal, bore wall reinforcement, and smoother straighter bore holes are achieved.

2. The apparatus of claim 1 wherein said apparatus can be adapted to well casing using standard drilling subs, whereby less costly non-rotational casing drilling, reaming and cutting of target materials, cuttings removal, bore wall reinforcement, and smoother straighter bore holes are achieved.

3. The apparatus of claim 1 wherein said apparatus can be adapted to down hole service lines using standard drilling subs, whereby said apparatus may be used to drill, ream, or cut through obstructions, debris, broken pipe or lost equipment and thereby salvage a well from abandonment.

4. The apparatus of claim 1 wherein said apparatus can be adapted to directional drilling devices using standard drilling subs, whereby directional drilling, reaming and cutting of target materials, cuttings removal, bore wall reinforcement and smoother straighter bore holes are achieved.

5. The apparatus of claim 1 wherein the orbital, gyrating and counter-rotational design of the apparatus resists wear, whereby fewer trips in and out of the well are required and rate of penetration is thereby increased.

6. An apparatus for drilling, reaming, or cutting a bore hole comprising:

a) a housing means adapted to receive drilling fluid mixture of liquid, gas and solids flow under a multitude of pressures and temperatures, the housing means diverting at least a portion of said drilling fluid mixture horizontally and vertically through passageways;

b) a substantially circular moving means urged by said diverted portion of said drilling fluid mixture to orbit and gyrate, with slight counter-rotation of the substantially circular moving means in the opposite direction of said moving means rolling within the substantially circular interior of said housing means thereby minimizing relative movement, friction and wear between the moving means and housing means, as said drilling fluid mixture is fired from within said housing means, said housing means is urged by said drilling fluid mixture to orbit and gyrate, whereby said drilling fluid mixture drills, reams, and cuts.

7. An apparatus of claim 6 wherein said housing means can be adapted to well casing using standard drilling subs, whereby less costly non-rotational casing drilling, reaming and cutting are achieved.

8. An apparatus of claim 6 wherein said housing means can be adapted to down hole service lines using standard drilling subs, whereby said apparatus may be used to drill, ream, or cut through obstructions, broken pipe or lost equipment and thereby salvage a well from abandonment.

9. An apparatus of claim 6 wherein said housing means can be adapted to directional drilling devices using standard drilling subs, whereby directional drilling, reaming and cutting of target materials, cuttings removal, bore wall reinforcement and smoother straighter bore holes are achieved.

10. An apparatus of claim 6 wherein the orbital design of the means resists wear, whereby fewer trips in and out of the well to replace or repair the means are required and rate of penetration is thereby increased.

11. A method for drilling, reaming or cutting comprising:

a) adapting a tool for receiving a supply of pressurizing drill fluid containing a mixture of liquids, gas and solids, at a multitude of temperatures, distributing said pressurizing drill fluid within said tool vertically and horizontally, b) placing a substantially circular device within said tool, said pressurizing drill fluid urging an orbiting motion of said tool, and said pressurizing drill fluid urging orbiting and gyrating of said device while discharging said pressurizing fluid from within said tool, thereby minimizing relative movement, friction and wear between the tool and the device due to slight counter-rotation of the substantially circular device in the opposite direction of said device rolling within the substantially circular interior of said tool, whereby results are achieved in a wide variety of drilling, reaming and cutting applications.

12. The method of claim 11 wherein said tool orbiting against the walls of the borehole is compacting said walls, whereby the walls are strengthened against collapse.

13. The method of claim 11 wherein said tool orbiting within the bore hole is stirring the returning fluid, whereby said returning fluid more effectively and quickly removes cuttings from said bore hole.

14. The method of claim 11 wherein said tool is orbiting while said device is orbiting and discharging said pressurizing drill fluid, whereby casing may be drilled, reamed or cut to complete a well.

15. The method of claim 11 wherein said tool is orbiting while said device is orbiting and discharging said pressurizing drill fluid, whereby well boring in soft, sticky, hard and combined consolidated and unconsolidated target material is achieved.

16. The method of claim 11 wherein said tool is orbiting while said device is orbiting and discharging said pressurizing drill fluid, whereby cuttings are swept up out of the bottom of the borehole so new formation is exposed.

17. The method of claim 11 wherein said tool is orbiting while said device is orbiting and discharging said pressurizing drill fluid, whereby substantial quantities of cuttings are compacted into the borehole walls by the impact of said tool thereby reducing the cuttings requiring removal from said pressurizing drill fluid during recycling of said pressurizing drill fluid.

18. The method of claim 11 wherein said tool is orbiting while said device is orbiting and discharging said pressurizing drill fluid, whereby various mixtures of said pressurizing drill fluid can be utilized for removal of each of the various target material encountered.

19. The method of claim 11 wherein said tool is orbiting while said device is orbiting and discharging said pressurizing drill fluid, whereby weight on bit and torque is eliminated, reducing breaking and sticking of pipe.

20. The method of claim 11 wherein said tool is orbiting while said device is orbiting and discharging said pressurizing drill fluid, whereby the cutting stream never becomes dull and the rate of penetration remains constant.

* * * * *